United States Patent [19]

Nagae et al.

[11] 4,163,679

[45] Aug. 7, 1979

[54] ALUMINUM TREATMENT WITH ALKALINE SOLUTION AND TANNIN

[75] Inventors: Yoshio Nagae; Takashi Utsumi, both of Yokohama, Japan

[73] Assignee: Oxy Metal Industries Corporation, Warren, Mich.

[21] Appl. No.: 891,971

[22] Filed: Mar. 30, 1978

[30] Foreign Application Priority Data

Mar. 31, 1977 [JP] Japan ..... 52-35498

[51] Int. Cl.[2] ..... C23F 7/00; C23F 7/06

[52] U.S. Cl. ..... 148/6.27; 148/6.15 R

[58] Field of Search ..... 148/6.27

[56] References Cited

U.S. PATENT DOCUMENTS

| | | | |
|---|---|---|---|
| 3,975,214 | 8/1976 | Kulick et al. | 148/6.15 R |
| 4,017,334 | 4/1977 | Matsushima et al. | 148/6.27 |
| 4,054,466 | 10/1977 | King et al. | 148/6.27 |
| 4,063,969 | 12/1977 | Howell | 148/6.27 |

*Primary Examiner*—Ralph S. Kendall

*Attorney, Agent, or Firm*—Arthur E. Kluegel; Richard P. Mueller

[57] ABSTRACT

A chromium-free treatment for aluminum imparts corrosion resistance and paint receptivity to the surface. The process is sequential and includes a first contact with an aqueous alkaline solution (pH above 10) containing complexed iron ion, water rinsing, and then contact with an aqueous acidic organic tannin-containing composition.

3 Claims, No Drawings

ALUMINUM TREATMENT WITH ALKALINE SOLUTION AND TANNIN

BACKGROUND OF THE INVENTION

The present invention relates to a process for treating the surface of aluminum and its alloys. It is a prime object of this invention to provide a protective coating having desirable appearance, high corrosion resistance and high adhesion of top coated paints on the surface of aluminum and its alloys for cans, building materials, automobiles, electric appliances and the like.

The surface of aluminum and its alloys has conventionally been treated with a strong alkaline etching cleaner solution, rinsed with water and then chromated or oxidized anodically. The chromating process has well-known environmental and health disadvantages due to the presence of chromium. The anodizing process requires large and expensive equipment and a large amount of power, and is therefore economically undesirable.

U.S. Pat. Nos. 3,975,214 and 4,054,466 disclose metal treatment processes employing aqueous organic tannin solutions.

SUMMARY OF THE INVENTION

It has now been found that the surface of aluminum and its alloys can be provided with corrosion resistant and paint receptive properties without the use of chromium compounds by treating the surface with an aqueous alkaline solution containing iron ion and a complexing agent and having a pH of higher than 10, rinsing the treated surface with water, and then treating the surface with an aqueous acidic solution containing an organic tannin.

DETAILED DESCRIPTION OF THE INVENTION

The aqueous alkaline solution contains one or more compounds conventionally employed for upward pH adjustment such as alkali metal or ammonium hydroxides, phosphates, carbonates, borates and the like in a concentration sufficient to achieve the desired pH value, normally ranging from 0.1 to 50 g/liter and preferably from 1 to 10 g/liter. The pH value of the solution ranges from 10 to 14, preferably from 11.5 to 13.5. At a pH of lower than 10, similar effects may be achieved but the etching rate is too slow for most production lines.

Any iron compound soluble in the solution may be employed such as $FeSO_4$, $Fe_2(SO_4)_3$, $FeCl_2$, $FeCl_3$, $Fe(OH)_2$, $Fe(OH)_3$, FeS, $FeS_2$, FeO, $Fe_2O_3$, organic chelate compounds and the like. The amount of iron compound added to the aqueous alkaline solution is at least 0.01 g/liter, is preferably less than 10 g/liter and most preferably from 0.1 to 1 g/liter.

A complexing agent is employed to dissolve and maintain the iron in solution. Inorganic complexing agents include polyphosphoric acids such as pyrophosphoric, tripolyphosphoric and hexa metaphosphoric acids and alkali metal salts thereof. Organic complexing agents include those conventionally employed in alkaline mediums such as dicarboxylic acids such as malonic or fumaric acid; aminoacids such as glycine, hydroxycarboxylic acids such as maleic, citric, glyconic or lactic acid; hydroxyl aldehydes such as acetylacetone; polyhydroxyl aliphatic compounds such as sorbitol or 1,2-ethanediol; phenolic carboxylic acids such as salicylic or phthalic acid; aminocarboxylic acids such as ethylenediaminetetraacetic acid; salts of polyaminoacids such as diethanolaminomethane sulfonate and lignine sulphonate and the like. More preferred agents include hexahydroheptonic acid, sodium gluconate and sodium ethylenediaminetetraacetate.

The iron compound and complexing agent may be dissolved in the aqueous alkaline solution by any desired method. An effective method for dissolving the iron ion comprises mixing a water-soluble iron compound in an aqueous solution containing a complexing agent. The iron ion can be stabilized in the aqueous solution by the action of the complexing agent. It is preferred to then render the solution alkaline by adding the alkaline component to the resulting solution.

When an iron salt is not easily dissolved in an aqueous solution of a complexing agent, it may be dissolved by adding an acid such as sulfuric acid, hydrofluoric acid or the like and then treated in the manner as referred to above.

If desired, the aqueous alkaline solution may contain a surface active agent. Such an addition is particularly advantageous when the surface of the metal to be treated is fouled with grease of oil. The surface active agent may be non-ionic, cationic or amphoteric. Amounts up to 50 g/liter may be used and preferable amounts may range from 0.1 to 5 g/liter. The aqueous alkaline solution may be used at a temperature from ambient to the boiling point of the solution for a contact period of time sufficient to form a protective coating thereon by any conventional technique such as spraying, immersion or brushing. It is preferable to treat the surface at a temperature from 50° to 90° C. for a period from 3 to 60 seconds in view of the properties to be achieved and typical plant economics. After treatment with the aqueous alkaline solution containing iron ion and a complexing agent, the workpiece is rinsed with water.

Subsequently, the workpiece is treated with an aqueous acidic solution containing an organic tannin. The tannin and tannic acid usable in the process of this invention include quebracho-tannin, depside tannin, Chinese tannic acid, Turkish tannic acid, hamamelitannin, chebulinic acid, sumac tannin, Chinese gallotannin, ellagitannin, and the like.

The concentration of the tannin is at least 0.01 g/l and preferably from 0.1 to 50 g/liter, most preferably from 1 to 10 g/liter.

The aqueous solution containing the organic tannin should be used on the acid side, the pH ranging from 1.5 to 6.0, preferably from 2.0 to 4.0. At a pH of less than 1.5, too much etching will occur. At a pH of higher than 6.0, the reaction will occur too slowly for most production lines.

The aqueous tannin solution may be applied to the surface of aluminum or its alloys at a temperature from ambient to the boiling point of the solution for a period of time sufficient to form a protective coating thereon by any conventional technique such as immersion, spraying or brushing.

After the treatment with the aqueous acidic solution, the workpiece may be rinsed with water or squeezed through rolls to remove the excessive amount of the solution, followed by drying.

If desired, the aqueous tannin solution may contain metal ions such as alkali metal, alkaline earth metal, aluminum, titanium, vanadian, hafnium, manganese, iron, cobalt, nickel, copper, zinc or zirconium. Such metal ions may be intentionally added or brough from the treating solution from the preceding step because of entrainment on the surface or may be dissolved from the surface of aluminum or its alloys being treated. The total amount of such metal ion is preferably less than 2 g/liter. When metallic salts are precipitated, they may be stabilized in the solution by adding a complexing agent.

In addition, the aqueous acidic tannin solution may include one or more acids such as phosphoric acid, boric acid, polyphosphoric acid, phytic acid, hydrofluoric acid, fluorosilicic acid, fluorotitanic acid, fluorizirconic acid or their soluble metal salts. The amount of such additives should be such as to maintain the pH value in the desired range.

The present invention will be now illustrated by way of the following examples.

EXAMPLE I

Alloyed aluminum panels (Material No. 5052) having a size of 50 mm×100 mm×0.3 mm were treated at 65° C. for 6 seconds by spraying with an aqueous alkaline solution prepared by dissolving 70 g of sodium hydroxide, 2 g of ferric ion in the form of ferric sulfate and 18 g of sodium gluconate in 10 liters of water. After rinsing with water, the panels were treated at 55° C. for 6 seconds by spraying with an aqueous solution prepared by dissolving 50 g of tannic acid (Chinese gallotannin) in 10 liters of water and a pH value of 3.5 followed by rinsing with water, rinsing with demineralized water and drying.

The thus treated panels were then subjected to the salt spray test according to JIS-Z-2371 and the humidity test according to JIS-Z-0228. In addition, another identically prepared set of panels was painted with an epoxy paint (available from Kansai Paint Co. under the trade name of Kancoat XJL165L Clear) to a thickness of from 5 to 6 microns and baked at 205° C. for 10 minutes. The painted panels were then subjected to the salt spray test and paint adhesion test. Excellent paint adhesion results were obtained for the invention and comparative tests. Tables 1 and 2 show the results obtained in the salt spray and humidity testing.

COMPARATIVE EXAMPLE 1a

Panels identical to those of Example 1 were treated at 65° C. for 6 seconds by spraying with a strong alkaline cleaning solution prepared by dissolving 70 g of sodium hydroxide and 18 g of sodium gluconate in 10 liters of water, rinsed with water and then demineralized water and dried. The thus treated panels were subjected to the salt spray test and humidity test under the same conditions as in Example 1. Results obtained are shown in Tables 1 and 2.

COMPARATIVE EXAMPLE 1b

Panels identical to those of Example 1 were treated at 65° C. for 6 seconds by spraying with an aqueous alkaline solution prepared by dissolving 70 g of sodium hydroxide, 18 g of sodium gluconate and 2 g of ferric ion in the form of ferric sulfate in 10 liters of water, rinsed with water and then with demineralized water and dried. The thus-treated panels were then subjected to the salt spray test and humidity test under the same conditions as in Example 1. Tables 1 and 2 show the results obtained.

COMPARATIVE EXAMPLE 1c

Panels identical to those of Example 1 were treated with the same strong alkaline cleaning solution as in Comparative Example 1a at 65° C. for 6 seconds by spraying and then rinsed with water. The treated sheets were then treated at 55° C. for 6 seconds by spraying with an aqueous solution prepared by dissolving 50 g of a tannic acid (Chinese gallotannin) in 10 liters of water and adjusting the pH to a value of 3.5, rinsed with water and then with demineralized water and dried. Some panels were painted as in Example 1. The treated panels were then subjected to the salt spray test and humidity test under the same conditions as in Example 1. Tables 1 and 2 show the results obtained.

COMPARATIVE EXAMPLE 1d

Panels identical to those of Example 1 were chromated with a conventional bath containing chromium phosphate so that a chromate coating of 20 mg/m$^2$ was provided. Some panels were painted as in Example 1. The chromated panels were subjected to the salt spray test and humidity test under the same conditions as in Example 1. Tables 1 and 2 show the results obtained.

Table 1

| | | Unpainted Panels | |
|---|---|---|---|
| Ex. | | 48 Hour Salt Spray Test-% White Rust | 48 Hour Humidity test-% White Rust |
| 1 | Invention | 5% | 0 |
| 1a | Clean only | 90% | 90% |
| 1b | No tannin treatment | 70% | 90% |
| 1c | No iron treatment | 70% | 70% |
| 1d | Conventional chromate | 0% | 5% |

Table 2

| | | Painted Panels |
|---|---|---|
| Example | | 500 Hour Salt Spray Corrosion Width-mm |
| 1 | Invention | 0 |
| 1a | Clean Only | 0–1 |
| 1b | No tannin treatment | 0–1 |
| 1c | No iron treatment | 0–1 |
| 1d | Conventional Chromate | 0 |

What is claimed is:

1. A chromium-free process for imparting corrosion resistance to a surface of aluminum and its alloys, comprising:

(a) contacting the surface with an aqueous alkaline solution having a pH value of at least 10 and comprising complexed iron ions in a concentration of at least 0.01 g/l iron;

(b) rinsing the surface with water; and (c) contacting the surface with an aqueous acidic solution containing at least 0.01 g/l of an organic tannin.

2. The process of claim 1 wherein the alkaline solution exhibits a pH value of from 11.5 to 13.5.

3. The process of claim 1 wherein the acidic solution exhibits a pH value of from 1.5 to 6.0.

* * * * *